United States Patent [19]

Beller et al.

[11] Patent Number: 4,533,803

[45] Date of Patent: Aug. 6, 1985

[54] SWITCH CONSTRUCTION

[75] Inventors: Wilbert E. Beller, Park Ridge; George D. Georgacakis, Skokie; George Obermann, Niles, all of Ill.

[73] Assignee: The Singer Company, Stamford, Conn.

[21] Appl. No.: 542,865

[22] Filed: Oct. 17, 1983

[51] Int. Cl.[3] ..... H01H 21/24

[52] U.S. Cl. ..... 200/153 K; 200/276; 200/290; 200/339

[58] Field of Search ..... 200/153 K, 153 M, 67 C, 200/271, 276, 290, 291, 339

[56] References Cited

U.S. PATENT DOCUMENTS

| | | | |
|---|---|---|---|
| 2,215,319 | 9/1940 | Brown | 200/153 M |
| 2,900,460 | 8/1959 | Wallace | 200/153 K |
| 3,178,522 | 4/1965 | Passarelli, Jr. | 200/6 C |
| 3,299,241 | 1/1967 | Sayward | 200/246 |
| 3,471,663 | 10/1969 | Farrell et al. | 200/153 M |
| 3,519,775 | 7/1970 | Weremey | 200/153 R |
| 3,548,137 | 12/1970 | Farrell et al. | 200/291 |
| 3,860,776 | 1/1975 | Lockard | 200/276 |
| 4,114,002 | 9/1978 | Hochgesang | 200/67 C |
| 4,336,429 | 6/1982 | Jackson et al. | 200/67 DB |

OTHER PUBLICATIONS

Pickering, C. E.-Research Disclosure #17840 for Electrical Switch-Feb. 1979.

*Primary Examiner*—Stephen Marcus
*Assistant Examiner*—Renee S. Kidorf
*Attorney, Agent, or Firm*—David L. Davis; Robert E. Smith; Edward L. Bell

[57] ABSTRACT

A momentary contact rocker switch utilizes a pair of torsion springs as movable switch contacts, with fixed terminal posts being used as fixed contacts. The terminal posts are grooved in the region of contact with the torsion spring to provide a wiping action. This wiping action, along with the high electrical contact forces provided by the torsion spring, eliminates the need for silver contacts.

9 Claims, 12 Drawing Figures

SWITCH CONSTRUCTION

BACKGROUND OF THE INVENTION

This invention relates to the construction of a momentary contact switch and, more particularly, to a rocker-type momentary contact switch useful in automotive applications.

Momentary contact rocker switches are typically utilized in the automotive industry, for example, to remotely control the raising and lowering of power driven windows in an automobile. These switches must be capable of handling the necessary current required to drive the motor and must also be highly reliable. It is also desirable that the switch have low actuator travel. Of course, an economical construction with simplicity of parts for ease of assembly is also a desirable characteristic.

It is therefore an object of this invention to provide an improved momentary contact rocker switch assembly.

SUMMARY OF THE INVENTION

The foregoing and additional objects are attained in accordance with the principles of this invention by providing a switch comprising a plurality of posts and an electrically conductive torsion spring having a central helical portion mounted on one of the posts and having first and second ends extending outwardly from the central helical portion. The ends of the torsion spring are biased toward contact with respective posts. An actuator is mounted for pivoting movement and is arranged to cooperate with the torsion spring so that when the actuator is in a neutral position there exists a first set of conditions with respect to the contacting of the spring ends with the respective posts, when the actuator is pivoted to one side of the neutral position there is a second set of conditions and when the actuator is pivoted to the other side of the neutral positions there is a third set of conditions.

In accordance with an aspect of this invention, the posts are formed with a groove in the region of contact with the respective spring ends.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
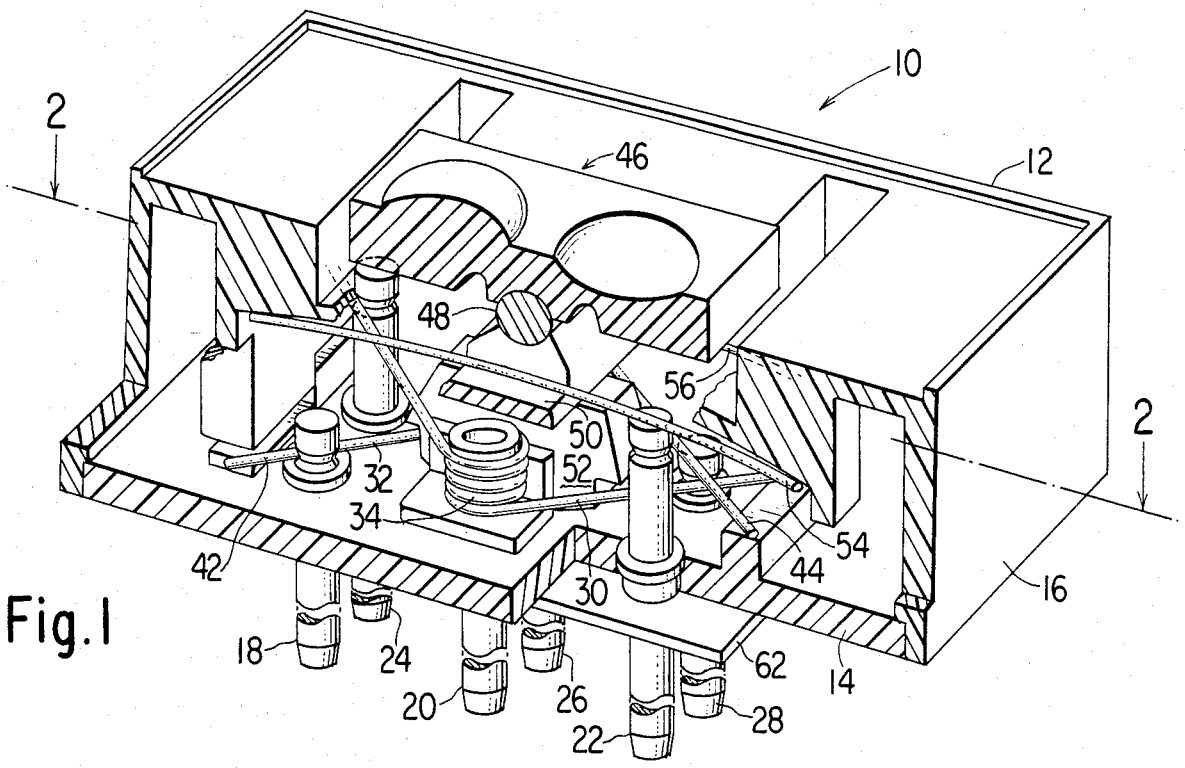
FIG. 1 is a cut away perspective view of a first embodiment of a switch constructed in accordance with the principles of this invention.

Referring now to the drawings, FIG. 1 illustrates a first embodiment of a switch, designated generally by the reference numeral 10, constructed in accordance with the principles of this invention. The switch 10 includes an insulated housing 12, preferably constructed of a base member 14 and a cover member 16. A plurality of electrically conductive terminal posts 18, 20, 22, 24, 26 and 28 extend through the base member 14 into the interior space of the housing 12. The posts 18–28 may be held to the base member 14 in any desired manner, illustratively by providing widened shoulders on the posts on one side of the base member 14 and frictional retaining clips on the posts on the other side of the base member 14.

The portions of the posts 18–28 extending externally of the housing 12 are utilized to make electrical contact for the switch 10, such as by insertion into an appropriately sized receptacle. The portion of the posts 18–28 which are inside the housing 12 serve as fixed switch contacts. The function of the movable switch contact is provided by the electrically conductive torsion springs 30 and 32. The spring 30 has a central helical portion 34 and first and second ends 36 and 38, respectively, extending therefrom. The central helical portion 34 is mounted on the post 20 and the ends 36 and 38 are biased toward contact with the posts 24 and 28, respectively. Similarly, the spring 32 has a central helical portion 40 mounted on the post 26 and first and second ends 42 and 44, respectively, extending from the central helical portion 40 and biased toward contact with the posts 18 and 22, respectively.

Figure 2:
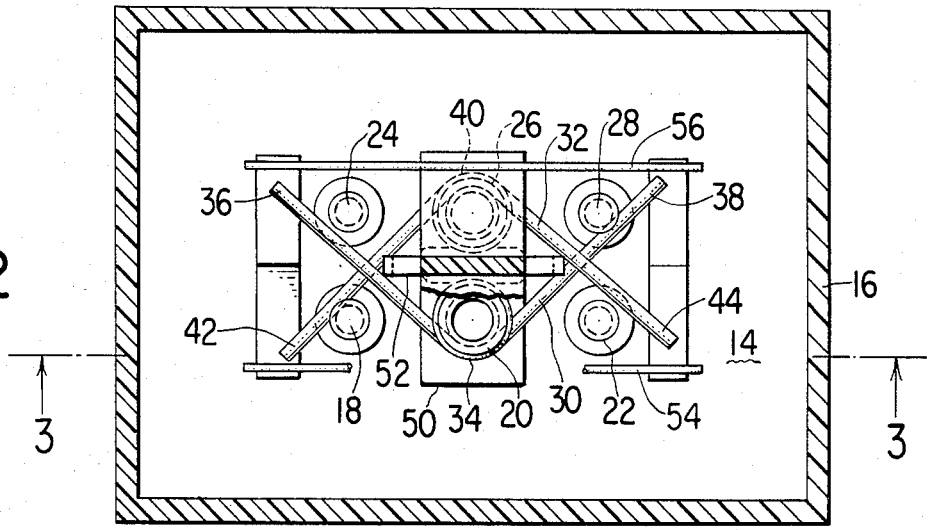
FIG. 2 is a sectional view taken generally along the line 2—2 in FIG. 1.

To effect the switching function, there is provided an actuating member 46. The actuating member 46 is mounted for pivoting movement in the cover member 16, illustratively about the pivot pin 48. The actuating member 46 is formed with a shoulder member 50 below the pivot pin 48 and a spring actuator 52 below the shoulder member 50. As is clear from FIGS. 1 and 2, the spring actuator 52 fits along a diagonal of the diamond shaped area defined by the arms of the springs 30 and 32, between the helical portions 34 and 40. The spring actuator 52 is arranged with an upper portion for contacting the upper arms of the springs 30 and 32 and a lower portion for contacting the lower arms of the springs 30 and 32. The switch 10 is also provided with a pair of wire springs 54 and 56 which act on the shoulder member 50 to center the actuating member 46 in a neutral position, the ends of the springs 54 and 56 bearing against projections of the cover member 16.

Figure 4A:
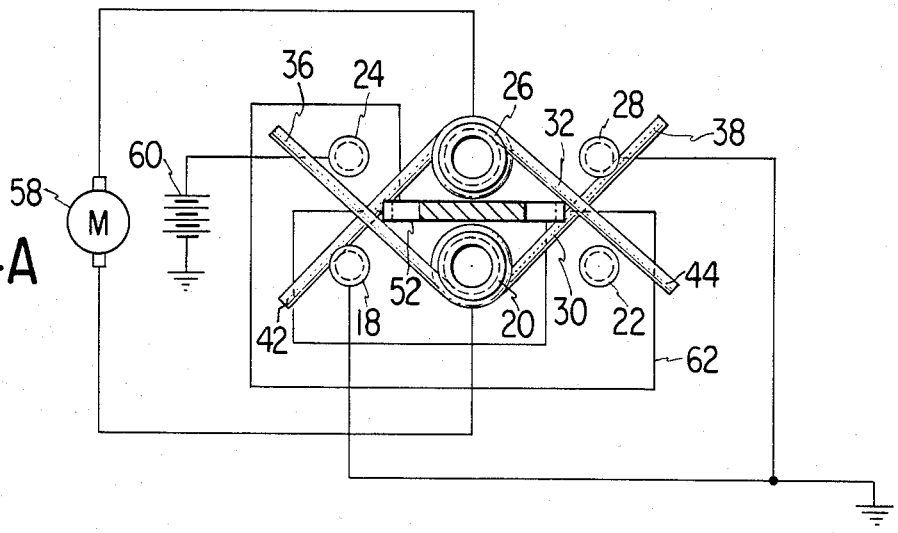
FIGS. 4A, 4B and 4C are schematic representations, partly electrical and partly mechanical, showing the three conditions of the switch of FIG. 1.
Figure 4B:
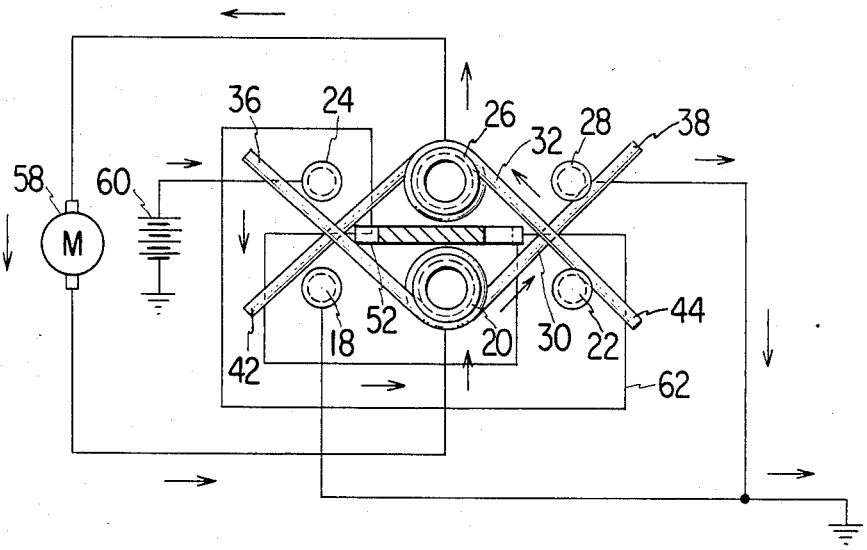
Figure 4C:
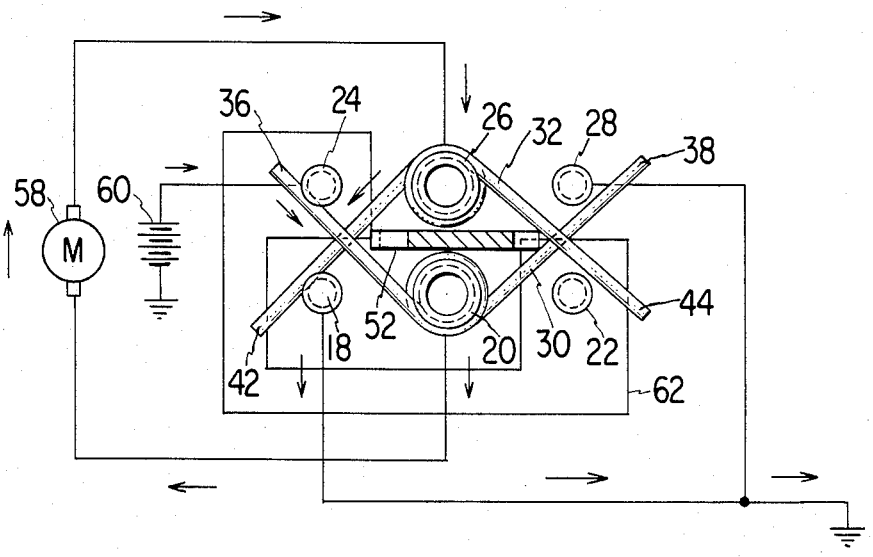
Figure 5:
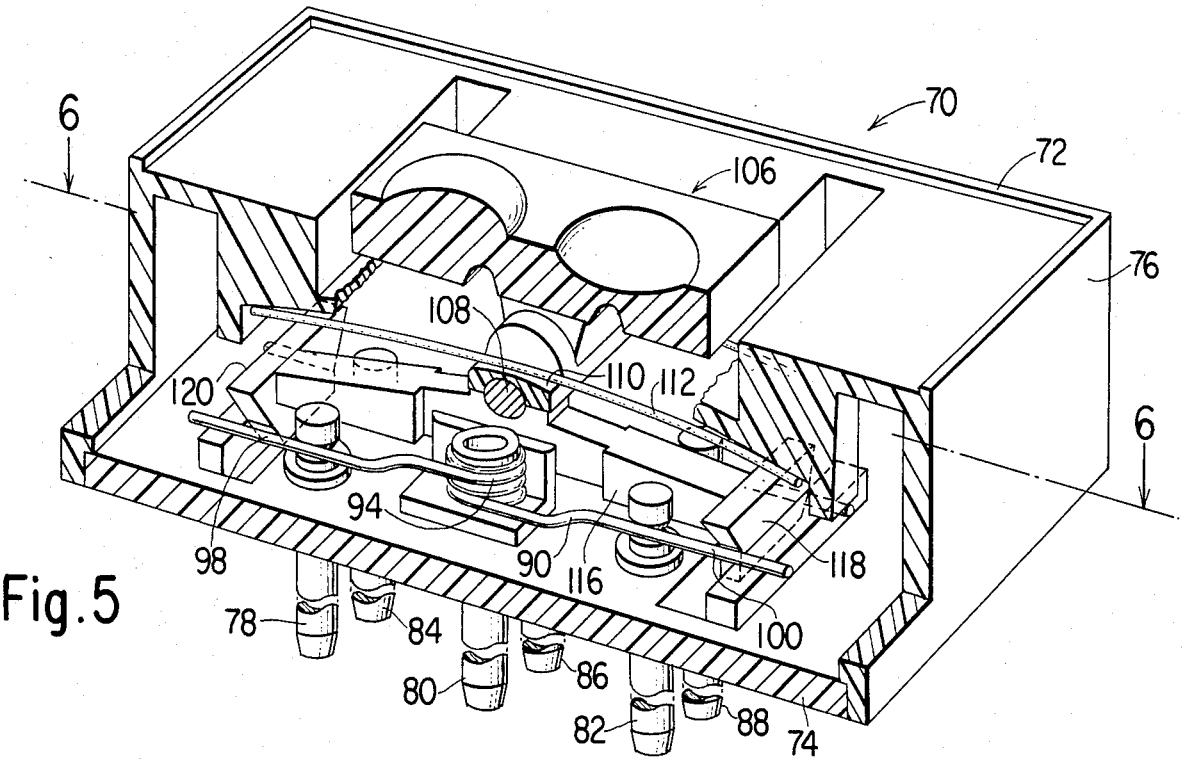
FIG. 5 is a cut away perspective view of a second embodiment of a switch constructed in accordance with the principles of this invention.
Figure 6:
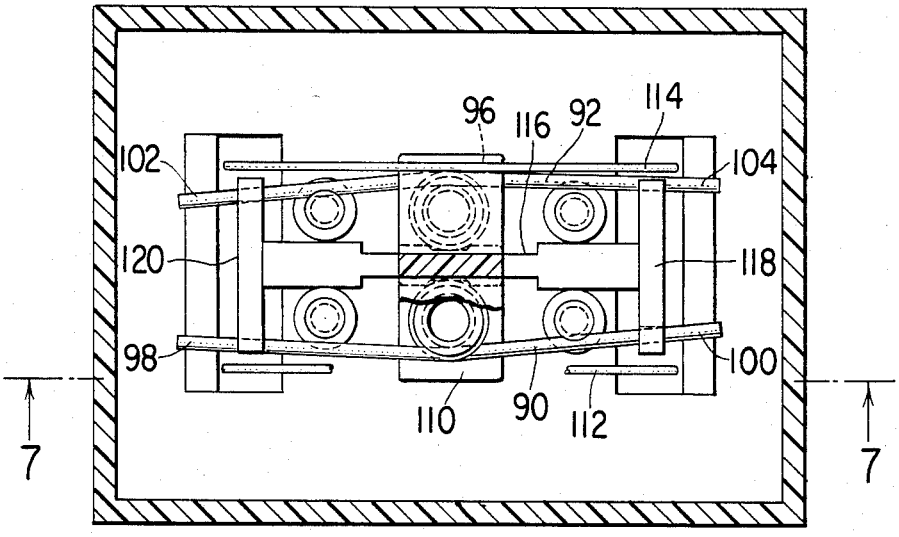
FIG. 6 is a sectional view taken generally along the line 6—6 of FIG. 5.
Figure 7:
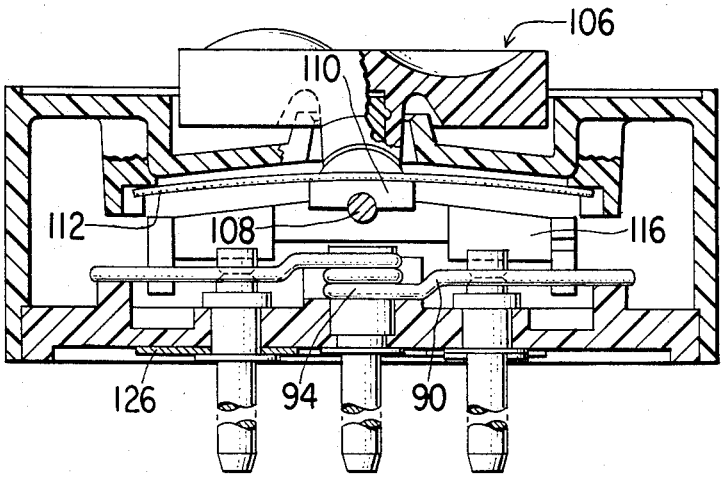
FIG. 7 is a sectional view taken generally along the line 7—7 of FIG. 6.

FIGS. 4A, 4B and 4C illustrate how the switch 10 may be utilized as a momentary contact double throw double pole reversing switch. FIG. 4A illustrates the switch 10 in its neutral position. Switch 10 is connected in electrical circuit with a reversible DC motor 58 and battery 60. Illustratively, the battery 60 may be an automobile battery and the motor 58 may be a power window motor. In any event, the anode of the battery 60 is connected to the post 24 and the cathode of the battery 60 is connected to ground. The motor 58 is connected to the posts 20 and 26. The posts 18 and 28 are connected to ground. Additionally, the posts 22 and 24 are electrically coupled together, by means of a conductive pad 62 affixed to the lower surface of the base member 14. As is shown in FIG. 4A, with the actuating member 46 in its neutral position, the spring end 38 is allowed to contact the post 28 and the spring end 42 is allowed to contact the post 18, while the spring ends 36 and 44 are prevented from contacting the respective posts 24 and 22. With this condition of the switch 10, there is no current path from the battery 60 through the motor 58.

Figure 3:
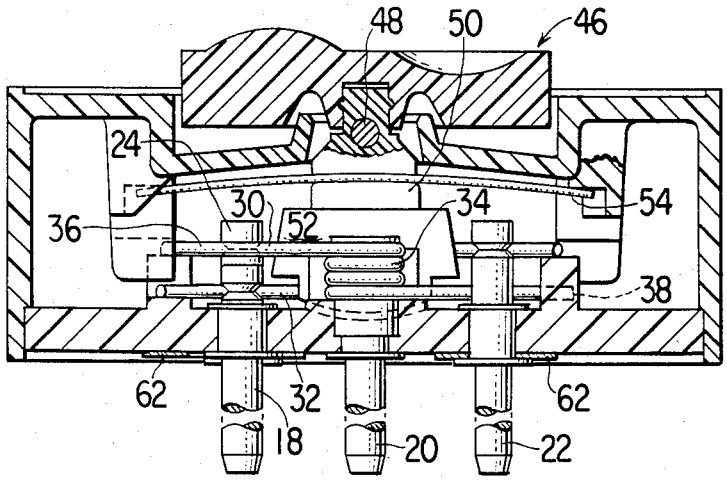
FIG. 3 is a sectional view taken generally along the line 3—3 in FIG. 2.

FIG. 4B illustrates the condition where the actuating member 46 has been pushed down on the right side (as viewed in FIGS. 1 and 3) so that the spring actuator 52 is pivoted to the left. In this condition, the spring ends 36 and 42 are kept from contacting their respective posts 24 and 18, while the spring ends 38 and 44 are allowed to contact their respective posts 28 and 22. As shown by the arrows in FIG. 4B, current can now flow from the anode of the battery 60 to the post 24, through the pad 62 to the post 22, through the end 44 of the spring 32 to the post 26, through the motor 58 in a first direction, to the post 20, to the end 38 of the spring 30, through the post 28, to ground. The motor 58 will then run in a first direction.

FIG. 4C illustrates the condition where the left side of the actuating member 46 (as viewed in FIGS. 1 and 3) is pushed down so that the spring actuator 52 is forced to the right. In this condition, the ends 38 and 44 are prevented from contacting their respective posts 28 and 22, while the ends 36 and 42 are allowed to contact their respective posts 24 and 18. Following the arrows in FIG. 4C, current will flow from the anode of the battery 60 to the post 24, through the spring end 36 to the post 20, through the motor 58 in a second direction, to the post 26, through the spring end 42, to the post 18, to ground. Accordingly, the motor 58 will run in a second direction.

In the embodiment described above, the torsion springs 30 and 32 provide a centering action to the actuator 46, so that the wire springs 54 and 56 may be eliminated, if desired.

For reliable switch operation without silver contacts, high contact force and contact wiping is required between terminal contact posts and spring contact arms. Accordingly, each of the posts 18, 22, 24 and 28 is formed with a groove where it is contacted by its respective switch end so that contact wiping is achieved as the spring actuator 52 forces the spring end out of the groove and also when the spring biasing force pulls the spring end into the groove.

A second embodiment of the inventive switch is shown in FIGS. 5, 6, 7, 8A, 8B and 8C. This embodiment differs from that described above in that the torsion springs are straight (i.e., they do not cross over) and the design of the actuator is modified accordingly. Thus, the switch designated generally by the reference numeral 70 includes a housing 72 having a base member 74 and a cover member 76. A plurality of electrically conductive terminal posts 78, 80, 82, 84, 86 and 88 extend through the base member 74 into the interior space of the housing 72. These posts 78–88 may be secured to the base member 74 in any desired manner. The portion of the posts 78–88 extending outwardly from the switch 70 are utilized for connecting the switch 70 to appropriate circuitry. The portions of the posts 78–88 inside the housing 72 are utilized as the fixed switch contacts. The movable switch contacts are the torsion springs 90 and 92. The torsion spring 90 has a central helical portion 94 which is mounted on the post 80. Likewise, the torsion spring 92 has a central helical portion 96 mounted on the post 86. The spring 90 has ends 98 and 100 extending outwardly from the central helical portion 94 and biased toward the posts 78 and 82, respectively. Likewise, the spring 92 has ends 102 and 104 extending outwardly from the central helical portion 96 and biased toward the posts 84 and 88, respectively. The posts 78, 82, 84 and 88 are formed with grooves in the region of contact with their respective spring ends.

To perform the switching function, the switch 70 is provided with an actuating member 106 mounted for pivoting movement about a pivot pin 108. The actuating member 106 is formed with a shoulder 110 for cooperation with a pair of wire centering springs 112 and 114. The actuating member 106 also includes an elongated spring actuator 116 which has at its ends a pair of cammed actuators 118 and 120 which are between respective pairs of spring ends and function when moved downwardly to force both of the respective spring ends out of contact with the respective posts and when moved upwardly to allow both of the respective spring ends to contact both of the respective posts and when in the neutral position only allow one of the respective spring ends to contact its respective posts. This action is illustrated in more detail in FIGS. 8A, 8B and 8C.

Figure 8A:
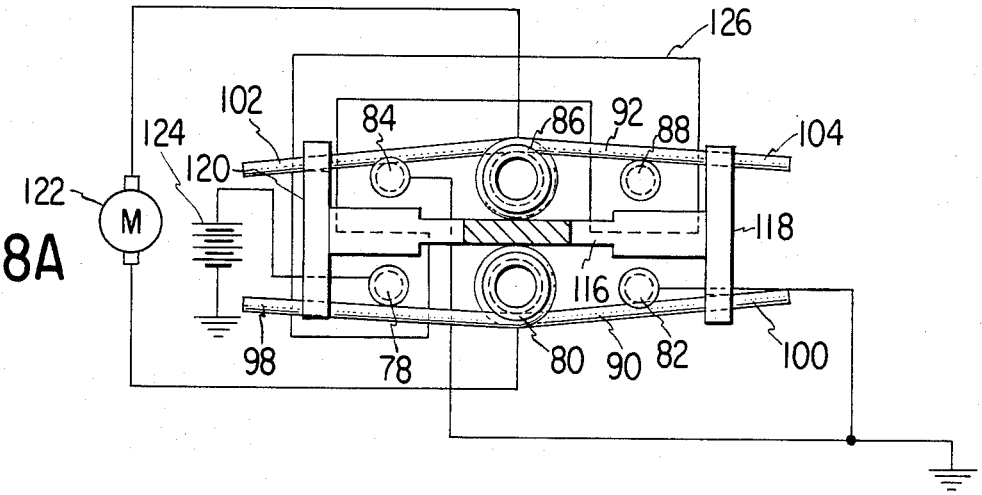
FIGS. 8A, 8B and 8C are schematic representations, partly electrical and partly mechanical, showing the three conditions of the switch of FIG. 5.

Referring now to FIG. 8A, shown therein is a schematic view of the switch 70 connected in electrical circuit with a reversible DC motor 122 and a battery 124. The anode of the battery 124 is connected to the post 78, which is connected to the post 88 by a conductive pad 126 on the underside of the base member 74. The motor 122 is connected to the posts 80 and 86. As shown in FIG. 8A, when the actuating member 106 is in its center, or neutral, position, the spring end 102 contacts the post 84 and the spring end 100 contacts the post 82, while the spring ends 98 and 104 are held from contacting the posts 78 and 88, respectively. Accordingly, there is no current path from the battery 124 to the motor 122.

Figure 8B:
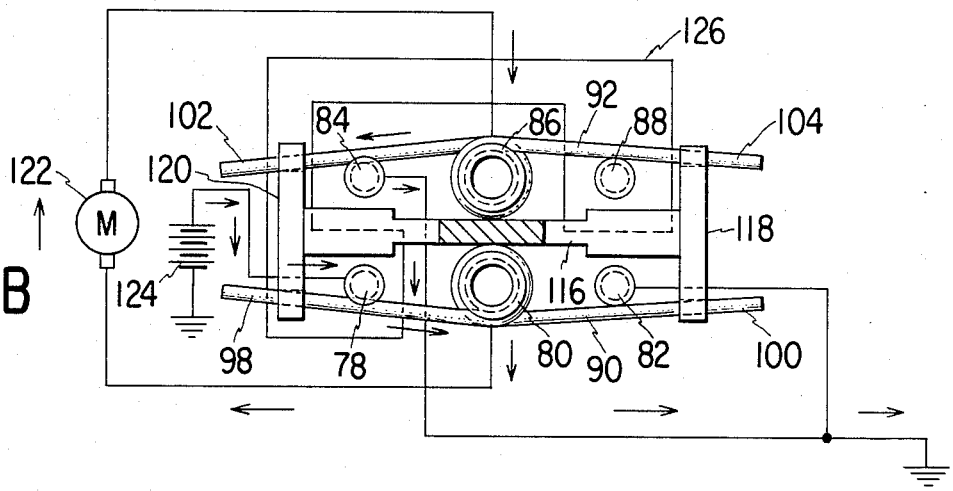

As shown in FIG. 8B, when the actuating member 106 is pivoted downwardly to the right (as viewed in FIGS. 5 and 7) the spring end 98 contacts the post 78 and the spring end 102 contacts the post 84, while the spring ends 100 and 104 are held from contacting the posts 82 and 88, respectively. In this condition, as shown by the arrows, there is a current path from the anode of the battery 124 to the post 78 through the spring 90, to the post 80, in a first direction through the motor 122, to the post 86, through the spring 92, to the post 84, to ground.

Figure 8C:
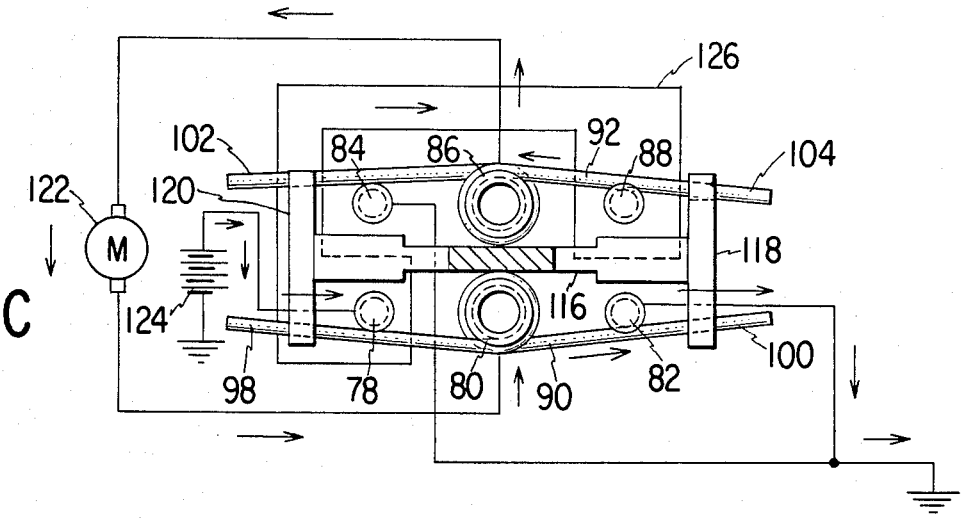

As shown in FIG. 8C, when the actuating member 106 is pivoted downwardly to the left (as viewed in FIGS. 5 and 7) the spring end 100 contacts the post 82 and the spring end 104 contacts the post 88, while the spring ends 98 and 102 are held from contacting the posts 78 and 84, respectively. In this condition, as shown by the arrows, there is a current path from the anode of the battery 124 to the post 78, through the conductive pad 126 to the post 88, through the spring 92 to the post 86, through the motor 122 in a second direction, to the post 80, through the spring 90, to the post 82, to ground.

Accordingly, there have been disclosed embodiments of a momentary contact rocker switch utilizing torsion spring switch elements. It is understood that the above-described embodiments are merely illustrative of the application of the principles of this invention. Numerous other embodiments may be devised by those skilled in the art without departing from the spirit and scope of this invention, as defined by the appended claims.

We claim:

1. A construction for a switch comprising:

a housing;

a plurality of electrically conductive terminal posts extending into said housing;

an electrically conductive torsion spring element having a central helical portion and first and second ends extending therefrom, said central helical portion being mounted on a first one of said posts and said first and second ends being biased toward contact with a second and a third of said posts, respectively;

an actuator mounted for pivoting movement is said housing, said actuator being arranged so that (a) when said actuator is in a neutral position said first spring end contacts said second post and said second spring end is held from contacting said third post;

(b) when said actuator is pivoted to one side of said neutral position said first spring end is held from contacting said second post and said second spring end contacts said third post; and (c) when said actuator is pivoted to the other side of said neutral position said first spring end contacts said second post and said second spring end is held from contacting said third post;

means for biasing said actuator to said neutral position; and means for providing electrical connections to said posts.

2. The construction according to claim 1 wherein said second and third posts are each formed with a groove in the region of contact with said first and second spring ends, respectively.

3. The construction according to claim 1 wherein said plurality of posts further includes fourth, fifth and sixth posts, said construction further comprising a second electrically conductive torsion spring element having a central helical portion mounted on said fourth post and first and second ends extending therefrom and biased toward contact with said fifth and sixth posts, respectively, said actuator being further arranged so that (a) when said actuator is in said neutral position said second torsion spring first end contacts said fifth post and said second torsion spring second end is held from contacting said sixth post;

(b) when said actuator is pivoted to said one side of said neutral position said second torsion spring first end contacts said fifth post and said second torsion spring second end is held from contacting said sixth post; and (c) when said actuator is pivoted to said other side of said neutral position said second torsion spring first end is held from contacting said fifth post and said second torsion spring second end contacts said sixth post; and means for providing electrical connections to said posts.

4. The construction according to claim 3 wherein said second, third, fifth and sixth posts are each formed with a groove in the region of contact with the respective spring ends.

5. A construction for a switch comprising:

a housing;

six electrically conductive terminal posts extending into said housing, said posts being substantially parallel to each other and linearly arrayed three on each side of a line perpendicular to the longitudinal axes of the posts;

a pair of electrically conductive torsion spring elements each having a central helical portion and first and second ends extending therefrom, each of said central helical portions being mounted on the middle post on a respective side of said line and each of said first and second ends of each of said springs being biased toward contact with a respective end post on a respective side of said line;

an actuator mounted in said housing for movement from a neutral position to either of two sides, said actuator being arranged so that (a) when said actuator is in said neutral position one spring end of each spring contacts a respective one of a pair of diagonally opposed end posts and the other spring end of each spring is held from contacting the respective one of the other pair of diagonally opposed end posts;

(b) when said actuator is moved to a first side of said neutral position, the spring ends associated with the end posts at one end of the array contact the respective end posts and the spring ends associated with the end posts at the other end of the array are held from contacting the respective end posts; and (c) when said actuator is moved to the second side of said neutral position, the spring ends associated with the end posts at the other end of the array contact the respective end posts and the spring ends associated with the end posts at the one end of the array are held from contacting the respective end posts;

means for biasing said actuator to said neutral position; and means for providing electrical connections to said posts.

6. The construction according to claim 5 wherein each of said spring elements has its central helical portion on a respective middle post on one side of said line and its ends extend across said line to cooperate with respective end posts on the other side of said line.

7. The construction according to claim 5 wherein each of said spring elements is entirely on a respective side of said line.

8. The construction according to claim 5 wherein said actuator is mounted for pivoting movement about an axis perpendicular to said line.

9. The construction according to claim 5 wherein each of said end posts is formed with a groove in the region of contact with the respective spring ends.

* * * * *